US009468953B2

(12) United States Patent
Allison

(10) Patent No.: US 9,468,953 B2
(45) Date of Patent: Oct. 18, 2016

(54) METHODS AND APPARATUSES FOR CLEANING AT LEAST ONE SURFACE OF AN ION SOURCE

(75) Inventor: John Allison, Lancaster (GB)

(73) Assignee: KRATOS ANALYTICAL LIMITED, Manchester (GB)

( * ) Notice: Subject to any disclaimer, the term of this patent is extended or adjusted under 35 U.S.C. 154(b) by 827 days.

(21) Appl. No.: 13/811,715

(22) PCT Filed: Jul. 28, 2011

(86) PCT No.: PCT/GB2011/001139

§ 371 (c)(1),
(2), (4) Date: Jan. 23, 2013

(87) PCT Pub. No.: WO2012/017190

PCT Pub. Date: Feb. 9, 2012

(65) Prior Publication Data

US 2013/0118523 A1 May 16, 2013

(30) Foreign Application Priority Data

Aug. 2, 2010 (GB) ..... 1013015.1

(51) Int. Cl.
*B08B 7/00* (2006.01)
*H01J 49/16* (2006.01)
*H01J 27/02* (2006.01)

(52) U.S. Cl.
CPC ..... *B08B 7/0057* (2013.01); *B08B 7/0042* (2013.01); *H01J 27/022* (2013.01); *H01J 49/164* (2013.01)

(58) Field of Classification Search
CPC .. B08B 7/0038; B08B 7/0042; B08B 7/0057
See application file for complete search history.

(56) References Cited

U.S. PATENT DOCUMENTS 5,118,937 A 6/1992 Hillenkamp et al.
5,654,545 A * 8/1997 Holle ..... H01J 49/405 250/282
6,500,268 B1 12/2002 Henley
6,762,405 B1 7/2004 Zhao et al.
6,953,928 B2 10/2005 Vestal et al.
6,958,480 B1 10/2005 Iyer et al.

(Continued)

FOREIGN PATENT DOCUMENTS

GB 2316528 A * 2/1998 ..... B08B 7/0042
GB 2398923 A 9/2004

(Continued)

OTHER PUBLICATIONS

International Search Report and Written Opinion dated Dec. 27, 2011 corresponding to International Application No. PCT/GB2011/001139.

(Continued)

*Primary Examiner* — Michael Kornakov
*Assistant Examiner* — Natasha Campbell
(74) *Attorney, Agent, or Firm* — Sughrue Mion, PLLC

(57) ABSTRACT

The present invention is concerned with methods and apparatus for cleaning the surface of an ion source in a mass spectrometer, for example an electrode of a MALDI ion source. The method includes directing UV light onto the surface to desorb contaminant material. The UV light source can be a laser and a moving reflecting surface can be used to direct the light on to the surface.

16 Claims, 4 Drawing Sheets

(56) References Cited

U.S. PATENT DOCUMENTS

| | | | |
|---|---|---|---|
| 7,541,597 | B2 | 6/2009 | Holle et al. |
| 2006/0016458 | A1 | 1/2006 | Novak et al. |
| 2007/0284541 | A1 | 12/2007 | Vane |
| 2009/0200457 | A1 | 8/2009 | Holle et al. |

FOREIGN PATENT DOCUMENTS

| | | | |
|---|---|---|---|
| GB | 2457362 | A | 8/2009 |
| JP | 1-204426 | A | 8/1989 |
| JP | 07-318552 | A | 12/1995 |
| JP | 2001-179198 | A | 7/2001 |
| JP | 2009-521788 | A | 6/2009 |
| WO | WO 2007/075856 | A2 | 7/2007 |
| WO | WO 2009/138134 | A1 | 11/2009 |

OTHER PUBLICATIONS

A. E. Duisterwinkel et al, "Feasibility of UV Cleaning of 157-nm Reticles," Microelectronic Engineering, Elsevier Publishers, vol. 67-68, Jun. 1, 2003, pp. 3-9, XP004428844.

* cited by examiner

METHODS AND APPARATUSES FOR CLEANING AT LEAST ONE SURFACE OF AN ION SOURCE

FIELD OF THE INVENTION

This invention relates to methods and apparatuses for cleaning at least one surface, preferably comprising a surface of an electrode, of an ion source for generating ions of sample material in a mass spectrometer. Preferably, the present invention relates to cleaning a surface of an electrode of a MALDI ion source.

BACKGROUND

TOF mass spectrometry is an analytical technique for measuring the mass/charge ratio of ions by accelerating ions and measuring their time of flight to an ion detector.

In a simple form, a TOF mass spectrometer includes an ion source for generating a pulse (or burst) of ions of sample material and an ion detector for detecting ions that have traveled from the ion source to the ion detector. The ions generated by the ion source preferably have, e.g. because they have been accelerated to, a predetermined kinetic energy and so have different speeds according to their mass/charge ratio. Accordingly, as ions travel between the ion source and the ion detector, ions of different mass/charge ratios are separated by their different speeds and so are detected by the ion detector at different times, which allows their respective times of flight to be measured based on an output of the ion detector. In this way, mass spectrum data representative of the mass/charge ratio of ions of sample material can be acquired based on an output of the ion detector.

Matrix-assisted laser desorption/ionization, often referred to as "MALDI", is an ionisation technique in which, generally, a laser is used to fire light at a (usually crystallised) mixture of sample material and light absorbing matrix so as to ionise the sample material. The sample materials used with MALDI typically include molecules such as biomolecules (e.g. proteins), large organic molecules and/or polymers. The light absorbing matrix is generally used to protect such molecules from being damaged or destroyed by light from the laser. The resulting ions, which typically have masses of several thousand Daltons, are then accelerated to high kinetic energies, typically around 20 keV. Generally, an ion source configured to generate ions by MALDI is referred to as a "MALDI ion source". A MALDI ion source typically includes a laser for ionising sample material by firing light at a mixture of the sample material and light absorbing matrix.

MALDI is usually combined with time of flight mass spectrometry to provide "MALDI TOF" mass spectrometry in which, generally, a pulse of ions is generated by MALDI and the time of flight of the ions is then measured over distances typically of around 1-2 meters so that the mass/charge ratio of the ions can be determined.

Measuring the time of flight of ions in modern TOF mass spectrometers, e.g. MALDI TOF mass spectrometers, typically requires a diverse range of high speed digital and analogue electronics. For example, high speed timing electronics may be used in order to accurately synchronise various high-voltage electrical pulses with the firing of a laser and the acquisition of an ion signal. Also, kV/μs slew-rate high voltage electrical pulses may be used to accelerate, gate and steer ionised molecules generated by the laser. Finally, high speed multi-bit analogue to digital converters may be used to record the output from an ion detector so that the time of flight of the ions, and therefore the mass/charge ratio of the ions, can be determined. Such high speed digital and analogue electronics are typically run for each acquisition cycle of the TOF mass spectrometer.

Until recently, TOF mass spectrometers, e.g. MALDI TOF mass spectrometers, have used gas lasers having a repetition rate (rate at which it can fire pulses of light) of up to a few tens of Hz. More recent TOF mass spectrometers have used solid-state lasers capable of much higher repetition rates, e.g. 1 kHz or more.

Generally, when a MALDI ion source is in use, a laser of the MALDI ion source fires a pulse of (e.g. UV) light at a mixture of sample material and light absorbing matrix contained in a sample spot so as to eject a plume of ionised and non-ionised (i.e. neutral) sample material ("analyte") and light absorbing matrix from the sample spot. The ionised material contained in this plume (mostly ions of sample material and some ions of light absorbing matrix) will generally be accelerated away by an electric field produced by electrodes of the MALDI ion source so as to pass through apertures in the electrodes, e.g. for subsequent detection by an ion detector. However, the non-ionised material contained in this plume (mostly non-ionised light absorbing matrix and some non-ionised sample material) will generally continue to expand from the sample spot until it is deposited on surfaces in the vicinity of the ion source, e.g. surfaces of the electrodes of the MALDI ion source.

Over time, the non-ionised material builds up on the surfaces in the vicinity of the sample spot, particularly on the surfaces of the electrodes of the MALDI ion source, to form an insulating layer of contaminant material that may charge up over time and adversely affect the operation of the MALDI ion source. In particular, the insulating layer of contaminant material on the electrodes can distort the electric field produced by the electrodes such that the sensitivity or resolution of a mass spectrometer using the MALDI ion source is degraded. At this point the electrodes of the MALDI ion source will generally require cleaning.

For many years the principal method of cleaning the electrodes of a MALDI ion source was to vent and open an evacuated housing containing the electrodes to allow the electrodes to be cleaned in situ or removed completely for thorough cleaning. In both cases, in addition to the cleaning time, several hours were generally required to restore a vacuum to the housing of the MALDI ion source (once closed) and to perform high voltage conditioning, instrument tuning and mass calibration procedures that are generally necessary for the MALDI ion source to be used in mass spectrometry.

In many applications (e.g. biochemistry) there is a growing requirement for higher throughput mass spectrometers, which can now be realised by the introduction of MALDI ion sources capable of running at repetition rates of 1 kHz or over. This has increased the rate of contamination build up on the electrodes of MALDI ion sources, and the frequency with which they must be cleaned, to such an extent that it is generally no longer practical to vent the MALDI ion source every time its electrodes require cleaning.

These considerations make it desirable to find an effective method to clean the electrodes of MALDI ion sources without requiring an evacuated housing of the MALDI ion source to be vented.

Various methods have been considered to clean the electrodes of MALDI ion sources without the need to vent an evacuated housing of the MALDI ion source.

For example, in GB2398923, Holle and Franzen proposed a method which uses a specially designed cleaning plate that is inserted into a MALDI ion source in place of a standard sample plate to clean a first electrode by spray-washing with solvent or mechanically with cleaning scrubbers.

In U.S. Pat. No. 7,541,597, Holle and Przybyla propose a method of cleaning electrodes of MALDI ion sources by etching with reactive ions produced by an electrically generated gas discharge in a specially admitted reactant gas, which can be automatically carried out by using a specially designed electrode place in place of a standard sample plate carrier and admitting a reactant gas.

The above mentioned methods share a disadvantage in that a special apparatus has to be inserted in place of a standard sample plate such that the precise location of sample material may be lost, which may be important in certain imaging applications. A further disadvantage may be the interruption of automated runs for mass spectrometers capable of automatically loading several sample plates.

Methods of cleaning the electrodes of MALDI ion sources have also been proposed in which the electrodes are heated to temperatures of up to 250° C., e.g. using contact heaters (U.S. Pat. No. 6,953,928, Vestel et al.) or with infrared laser radiation (GB2457362, Holle and Hohndorf). The effectiveness of heating the electrodes of MALDI ion sources has been found to be variable and depends very much on the light absorbing matrix used. For example, whilst DHB (2,5-dihydroxybenzoic acid) has been found to be readily removed by heating to temperatures of around 150° C., CHCA (α-Cyano-4-hydroxycinnamic) has been found to be much more stubborn and difficult to remove, even when heated to over 200° C. The amount of contaminant material present has also been found to have a significant effect on the effectiveness of heating in that it has been found much easier to remove thin layers of contaminant material by heating compared with relatively thick layers that can build up even in a relatively short time. Further, some contaminant materials, particularly polymers, can be very difficult to remove simply by heating.

The present invention has been devised in light of the above considerations.

SUMMARY OF THE INVENTION

In general, the invention relates to a method of cleaning at least one surface of an ion source for a mass spectrometer by directing light on to the surface such that contaminant material is desorbed from the surface. In this way, the at least one surface of the ion source can be cleaned in a simple manner, without having to significantly heat the surface and without having to vent an evacuated housing of the ion source.

In the context of this application, "light" is preferably taken to mean electromagnetic radiation (having any wavelength). "Desorption" of a substance from a surface is preferably mean the releasing/removal of that substance from the surface.

A first aspect of the invention may provide a method of cleaning at least one surface of an ion source for generating ions of sample material in a mass spectrometer, wherein the method includes:

directing UV light on to the at least one surface of the ion source such that contaminant material is desorbed from the at least one surface.

By directing UV light on to the at least one surface of the ion source, the UV light is able to couple energy directly into contaminant material on the at least one surface so as to cause the contaminant material to desorb from the at least one surface without having to significantly heat the at least one surface. This mechanism is different from, for example, the method proposed in GB2457362 in which infrared laser radiation (which is less energetic than UV light) is used to clean electrodes by deliberately heating the electrodes of MALDI ion sources up to a high temperature.

Preferably, the directing UV light on to the at least one surface of the ion source is such that there is substantially no heating of the at least one surface. Here, "substantially no heating" may be taken to mean that the temperature at the at least one surface of the ion source remains less than 80 degrees Celsius, more preferably that the temperature at the at least one surface of the ion source remains less than 60 degrees Celsius. This is different from, for example, the method proposed in GB2457362 in which infrared laser radiation is used to deliberately heat the electrodes of MALDI ion sources to at least 80 degrees Celsius.

Preferably, the at least one surface of the ion source comprises a surface of an electrode of the ion source. In other words, the method preferably includes directing UV light on to a surface of an electrode of the ion source such that contaminant material is desorbed from the surface of the electrode. As explained above, build up of contaminant material on the electrodes of ion sources is a particular problem in mass spectrometers. However, contaminant material can also build up on other surfaces of ion sources, e.g. surfaces in the vicinity of a sample spot of the ion source.

By UV ("ultra violet") light, it is preferably meant light having a wavelength of 450 nm or less, more preferably less than 400 nm or less, more preferably 390 nm or less (with no minimum wavelength). However, the UV light may have a wavelength of 10 nm or more, 100 nm or more, 200 nm or more or 300 nm or more. Accordingly, the UV light may have a wavelength in the range 10 nm to 390 nm, 400 nm or 450 nm; 100 nm to 390 nm, 400 nm or 450 nm; 200 nm to 390 nm, 400 nm or 450 nm; or 300 nm to 390 nm, 400 nm or 450 nm. Contaminant material, which may include light absorbing matrices such as DCTB, DHB, SA, DTL or CHCA, has been found to be particularly absorbent to light having a wavelength in these ranges, thereby allowing the light to couple energy directly into contaminant material on the at least one surface of the ion source so as to cause the contaminant material to desorb from the at least one surface without having to significantly heat the at least one surface.

The contaminant material may, for example, include or be non-ionised sample material and/or light absorbing matrix such as DCTB (T-2-(3-(4-t-Butyl-phenyl)-2-methyl-2-propenylidene)malononitrile), DHB (2,5-dihydroxybenzoic acid), SA (sinapinic acid), DTL (1,8,9-anthrecenetriol (dithranol)) or CHCA (α-Cyano-4-hydroxycinnamic acid). For example, the non-ionised sample material and/or the non-ionised light absorbing matrix could originate from a mixture of sample material and light absorbing matrix previously used in the ion source.

Preferably, the directing UV light on to the at least one surface of the ion source includes producing the UV light using a light source. The directing of UV light on to the at least one surface of the ion source may simply include moving the light source so that UV light produced by the light source is directed on to the at least one surface. However, the directing UV light on to the at least one surface of the ion source preferably includes reflecting UV light produced by a laser for ionising sample material, as will be described below.

Preferably, the ion source includes a laser for ionising sample material by firing light at the sample material. Preferably, the laser is for ionising sample material by firing pulses of light at the sample material. The laser preferably produces UV light.

Preferably, the UV light directed on to the at least one surface of the ion source is of a second wavelength that is approximately equal to or less than a first wavelength of light fired by a laser for ionising sample material. In this way, photons of the UV light directed on to the at least one surface of the ion source have an energy which is approximately equal to or greater than photons of the light fired by the laser. Accordingly, if the contaminant material was produced by firing light from the laser at the sample material (so as to desorb the contaminant material from the sample material), then the UV light directed on to the at least one surface of the ion source should be energetic enough to readily desorb the contaminant material from the at least one surface, without having to significantly heat the at least one surface.

Here, "approximately equal" preferably means equal to the extent that there is a difference in wavelength of no more than 300 nm, more preferably no more than 200 nm, more preferably no more than 100 nm, more preferably no more than 50 nm. Alternatively, "approximately equal" may mean equal to the extent that there is a percentage difference (or "error") of no more than 50%, 40%, 30%, 20%, 10%, 5%, 2% or 1%.

Preferably, the UV light directed on to the at least one surface of the ion source is produced by a laser for ionising sample material by firing light at the sample material. In other words, the laser for ionising the sample material is preferably the light source that produces the UV light that is directed on to the at least one surface of the ion source. This is a particularly elegant way of directing UV light on to the at least one surface of the ion source that is of a second wavelength that is approximately equal to a first wavelength of light fired by the laser for ionising the sample material. However, in other embodiments, the UV light directed on to the at least one surface of the ion source may be produced by a separate light source.

Preferably, the directing UV light on to the at least one surface of the ion source includes reflecting the UV light onto the at least one surface of the ion source via a reflecting surface. The reflecting surface is preferably provided by a mirror. Reflecting the UV light in this way is particularly useful if the UV light is produced by a laser for ionising sample material, since the UV light produced by the laser can be directed on to the at least one electrode of the ion source without moving the laser.

Preferably, the directing UV light on to the at least one surface of the ion source includes moving the reflecting surface into a path of the UV light so that the reflecting surface reflects the UV light. For example, the path of the UV light may be defined by a beam axis of a light source for producing the UV light, and the method may include moving the reflecting surface into a beam axis of the light source. Here, "beam axis" preferably means an axis extending in a direction of travel of UV light produced by the light source. The beam axis may be fixed for a given light source. As explained above, the light source may be a laser for ionising sample material.

Preferably, the reflecting surface is concave. In this way, the concave reflecting surface may be used to focus the UV light, in addition to directing the UV light. The curvature of the concave reflecting surface is preferably spherical, but may be parabolic or have any other suitable concave profile.

Preferably, the method includes moving the reflecting surface to scan Uv light from a source of UV light across the at least one surface of the ion source. Preferably the UV light is scanned across the at least one surface of the ion source in two dimensions. In this way, contaminant material can be desorbed from different locations across the at least one surface of the ion source. If the reflecting surface is concave, this scanning of UV light may be achieved by translating the concave reflecting surface in a plane, e.g. a plane that is substantially perpendicular to a beam axis of a light source for producing the UV light. As explained above, this light source may be a laser for ionising sample material.

Preferably, the reflecting surface is mounted on a sample holding means for holding sample material to be ionised by the ion source. In this way, both the reflecting surface, and sample material held by the sample holding means, can be moved into (and out from) a path of the UV light in place of sample material, by moving the sample holding means. The directing UV light on to the at least one surface of the ion source may include moving the sample holding means so as to move the reflecting surface into a path of the UV light so that the reflecting surface reflects the UV light.

Preferably, the reflecting surface is mounted on the sample holding means such that the reflecting surface is at a different distance from a laser for ionising sample material. This may be helpful in allowing the reflecting surface to reflect light from the laser on to the at least one surface of the ion source and/or focus the light to have a predetermined energy density at the at least one surface of the ion source.

The sample holding means may include a sample plate for holding sample material in one or more "sample spots". The sample holding means may include a sample plate carrier for carrying a sample plate. Preferably the reflecting surface is mounted on a part of the sample holding means that is configured to be removed from the ion source, e.g. the sample plate, thereby allowing the reflecting surface to be cleaned more easily.

Preferably, the method includes using the reflecting surface to visually assess the amount of contaminant material present on the at least one surface of the ion source, e.g. using a sample plate imaging system. This is an additional function which may be provided by the reflecting surface.

Preferably the method includes focussing the UV light such that the UV light has a predetermined energy density at the at least one surface of the ion source. The UV light may be focussed, for example, by a concave reflecting surface as described above, and/or by some other means for focussing the UV light, e.g. a lens. Also, the UV light may be focussed by a combination of a concave or planar reflecting surface and a lens.

Preferably, the method includes directing pulses of UV light on to the at least one surface of the ion source. The pulses of UV light may be produced, for example, by a laser for ionising sample material by firing pulses of light at the sample material. By directing pulses of UV light on to the at least one surface of the ion source, heating of the at least one surface may be reduced compared with directing a continuous stream of UV light on to the at least one surface, because heat is given an opportunity to dissipate between the pulses.

If the method includes directing pulses of UV light on to the at least one surface of the ion source, the method preferably further includes focussing the pulses of UV light such that each pulse of UV light has an energy density at the at least one surface of the ion source that is 1 $\mu J/mm^2$ or more, 10 $\mu J/mm^2$ or more, 100 $\mu J/mm^2$ or more, 200 $\mu J/mm^2$ or more, 400 $\mu J/mm^2$ or more or 500 $\mu J/mm^2$ or more; and/or 2000 $\mu J/mm^2$ or less, 1000 $\mu J/mm^2$ or less, 800 $\mu J/mm^2$ or less or 600 μJ/mm$^2$ or less. These values may be combined in any combination. For example, each pulse of UV light may have an energy density at a surface of the at least one surface of the ion source that is in the range 400 μJ/mm$^2$ to 800 μJ/mm$^2$. Such energy densities have been found to effectively desorb contaminant material with a single pulse of light.

Preferably, the method includes directing UV light on to a first surface and a second surface of the ion source such that contaminant material is desorbed from the first and second surfaces. Preferably, the first surface is a surface of a first electrode of the ion source and the second surface is a surface of a second electrode of the ion source. The first and second surfaces may be at different distances e.g. from a sample spot. Preferably, the UV light is directed on to the first and second surfaces at different times, e.g. by scanning the UV light across one surface then the other surface, rather than simultaneously.

Preferably, the method includes adjusting the focus of the UV light between a first focus and a second focus. Preferably, the method further includes directing UV light having the first focus onto a first surface of the ion source (which may be a surface of a first electrode of the ion source) and directing UV light having the second focus onto a second surface of the ion source (which may be a surface of a second electrode of the ion source). Preferably the first focus is such that the UV light is has a first predetermined energy density at the surface of the first surface. Preferably the second focus is such that the UV light has a second predetermined energy density at the surface of the second surface. Preferably, the first and second predetermined energy densities are approximately equal. Here, "approximately equal" preferably means equal to the extent that there is a percentage difference (or "error") of no more than 50%, 40%, 30%, 20%, 10%, 5%, 2% or 1%.

The focus of the UV light may be adjusted by directing UV light (which may, for example, be produced by a laser for ionising sample material) on to the at least one surface of the ion source using at least two concave reflecting surfaces, each concave reflecting surface having a different curvature, e.g. a different focal length. Any of the features described above in connection with a reflecting surface may apply to each of the at least two reflecting surfaces. Thus, the directing UV light on to the at least one surface of the ion source may include directing UV light having a first focus on to a first surface via a first concave reflecting surface and directing UV light having a second focus on to a second surface via a second concave reflecting surface. Similarly, the directing UV light on to the at least one surface of the ion source may include moving the first concave reflecting surface into a path of the UV light and moving the second concave reflecting surface into a path of the UV light.

However, the focus of the UV light may be adjusted in other ways. For example, in some embodiments, the focus of the UV light may be adjusted by adjusting a position of a lens in a path of the UV light (which may, for example, be produced by a laser for ionising sample material). The lens may be included, or associated with, a laser for ionising sample material, for example.

A second aspect of the invention relates to an apparatus for carrying out a method according to the first aspect of the invention.

Accordingly, a second aspect of the invention may provide an ion source for generating ions in a mass spectrometer, the ion source having:

means for directing UV light on to at least one surface of the ion source such that contaminant material is desorbed from the at least one surface.

The ion source may have any feature described in connection with any above aspect of the invention and/or may be configured to, or have means for, implementing any method step described in connection with any above aspect of the invention.

For example, preferably, the at least one surface of the ion source comprises a surface of an electrode of the ion source.

As another example, preferably the ion source includes a light source for producing the UV light. Preferably, the ion source includes a laser for ionising sample material by firing light (e.g. pulses of light) at the sample material. Preferably, the means for directing UV light is for directing, or configured to direct, UV light produced by a laser for ionising sample material on to at least one surface of the ion source such that contaminant material is desorbed from the at least one surface.

As another example, the means for directing UV light may includes a reflecting surface for directing the UV light on to the at least one surface of the ion source via the reflecting surface. Preferably, the reflecting surface is configured to be moved into a path of the UV light so that the reflecting surface reflects the UV light. Preferably, the reflecting surface is configured to be moved to scan UV light from a source of UV light across the at least one surface of the ion source.

As another example, the ion source preferably includes means for focussing the UV light such that the UV light has a predetermined energy density at the at least one surface of the ion source and/or means for adjusting the focus of the UV light between a first focus and a second focus and/or means for directing UV light having the first focus onto a first surface of the ion source and directing UV light having a second focus onto a second surface of the ion source. Preferably, the means for adjusting the focus of the UV light includes at least two concave reflecting surfaces, each concave reflecting surface having a different curvature. Alternatively, the means for adjusting the focus of the UV light may include means for adjusting a position of a lens in a path of the UV light.

A third aspect of the invention may provide a method of cleaning at least one surface of an ion source for generating ions of sample material in a mass spectrometer, the ion source having a laser for ionising sample material by firing light at the sample material, wherein the method includes:

directing light produced by the laser for ionising sample material on to the at least one surface of the ion source such that contaminant material is desorbed from the at least one surface.

In this way, photons of the light directed on to the at least one surface are able to have an energy which is approximately equal to photons of the light fired by the laser to ionise sample material. Accordingly, if the contaminant material was produced by firing light from the laser at the sample material (so as to desorb the contaminant material from the sample), then the light directed on to the at least one surface of the ion source should be energetic enough to readily desorb the contaminant material from the at least one surface, without having to significantly heat the at least one surface.

The light produced by the laser may be UV light, for example, but that need not be the case since other wavelengths of light can be used to ionise sample material.

The method may include any feature or method step described in connection with any other aspect of the invention, without the light directed on to the at least one surface of the ion source necessarily being UV light.

A fourth aspect of the invention relates to an apparatus for carrying out a method according to the third aspect of the invention.

Accordingly, a fourth aspect of the invention may provide an ion source for generating ions of sample material in a mass spectrometer, the ion source having:

a laser for ionising sample material by firing light at the sample material; and means for directing light produced by the laser for ionising sample material on to at least one surface of the ion source such that contaminant material is desorbed from the at least one surface.

The light produced by the laser may be UV light, for example, but that need not be the case since other wavelengths of light can be used to ionise sample material.

The ion source may have any feature described in connection with any above aspect of the invention and/or may be configured to, or have means for, implementing any method step described in connection with any above aspect of the invention, without the light directed on to the at least one electrode necessarily being UV light.

A fifth aspect of the invention may provide a method of cleaning at least one surface of an ion source for generating ions of sample material in a mass spectrometer, the ion source having a laser for ionising sample material by firing light of a first wavelength at the sample material, wherein the method includes:

directing light of a second wavelength on to the at least one surface of the ion source such that contaminant material is desorbed from the at least one surface, wherein the second wavelength is approximately equal to or less than the first wavelength.

In this way, photons of the light directed on to the at least one surface of the ion source have an energy which is approximately equal to or greater than photons of the light fired by the laser. Accordingly, if the contaminant material was produced by firing light from the laser at the sample material (so as to desorb the contaminant material from the sample), then the light directed on to the at least one surface of the ion source should be energetic enough to readily desorb the contaminant material from the at least one surface, without having to significantly heat the at least one surface.

Here, "approximately equal" preferably means equal to the extent that there is a difference in wavelength of no more than 300 nm, more preferably no more than 200 nm, more preferably no more than 100 nm, more preferably no more than 50 nm. Alternatively, "approximately equal" may mean equal to the extent that there is a percentage difference (or "error") of no more than 50%, 40%, 30%, 20%, 10%, 5%, 2% or 1%.

Preferably, the light directed on to the at least one surface of the ion source is produced by the laser for ionising sample material. In other words, the laser for ionising the sample material is preferably the light source that produces the light that is directed on to the at least one surface of the ion source. This is a particularly elegant way of directing light on to the at least one surface of the ion source that is of a second wavelength that is approximately equal to a first wavelength of light fired by the laser for ionising the sample material. However, in other embodiments, the light directed on to the at least one surface of the ion source may be produced by a separate light source.

The light produced by the laser may be UV light, for example, but that need not be the case since other wavelengths of light can be used to ionise sample material.

The light directed on to the at least one surface of the ion source may be UV light (as in the above described first aspect of the invention), but this need not be the case since other wavelengths of light may also be able to desorb contaminant material from the at least one surface.

The method may include any feature or method step described in connection with any other aspect of the invention, without the light directed on to the at least one surface of the ion source necessarily being UV light.

A sixth aspect of the invention relates to an apparatus for carrying out a method according to the fifth aspect of the invention.

Accordingly, a sixth aspect of the invention may provide an ion source for generating ions in a mass spectrometer, the ion source having:

a laser for ionising sample material by firing light of a first wavelength at the sample material; and means for directing light of a second wavelength on to at least one surface of the ion source such that contaminant material is desorbed from the at least one surface, wherein the second wavelength is approximately equal to or less than the first wavelength.

The light produced by the laser may be UV light, for example, but that need not be the case since other wavelengths of light can be used to ionise sample material.

The light directed on to the at least one surface of the ion source may be UV light (as in the above described first aspect of the invention), but this need not be the case since other wavelengths of light may also be able to desorb contaminant material from the at least one surface.

The ion source may have any feature described in connection with any above aspect of the invention and/or may be configured to, or have means for, implementing any method step described in connection with any above aspect of the invention, without the light directed on to the at least one electrode necessarily being UV light.

A seventh aspect of the invention may provide a method of cleaning at least one surface of an ion source for generating ions of sample material in a mass spectrometer, wherein the method includes:

directing light on to the at least one surface of the ion source such that the light couples energy directly into contaminant material on the at least one surface of the ion source such that contaminant material is desorbed from the surface.

In this way, the light is able to couple energy directly into contaminant material on the at least one surface so as to cause the contaminant material to desorb from the at least one surface without having to significantly heat the at least one surface. This mechanism is different from, for example, the method proposed in GB2457362 in which infrared laser radiation (which is less energetic than UV light) is used to clean electrodes by deliberately heating the electrodes of MALDI ion sources up to a high temperature.

The light directed on to the at least one surface of the ion source may be UV light (as in the above described first aspect of the invention), but this need not be the case since other wavelengths of light may also be able to desorb contaminant material from the at least one surface.

The method may include any feature or method step described in connection with any other aspect of the invention, without the light directed on to the at least one surface of the ion source necessarily being UV light.

An eighth aspect of the invention relates to an apparatus for carrying out a method according to the seventh aspect of the invention.

Accordingly, an eighth aspect of the invention may provide an ion source for generating ions in a mass spectrometer, the ion source having:

means for directing light on to the at least one surface of the ion source such that the light couples energy directly into contaminant material on the at least one surface of the ion source such that contaminant material is desorbed from the surface.

The light directed on to the at least one surface of the ion source may be UV light (as in the above described first aspect of the invention), but this need not be the case since other wavelengths of light may also be able to desorb contaminant material from the at least one surface.

The ion source may have any feature described in connection with any above aspect of the invention and/or may be configured to, or have means for, implementing any method step described in connection with any above aspect of the invention, without the light directed on to the at least one electrode necessarily being UV light.

A ninth aspect of the invention may provide a method of cleaning at least one surface of an ion source for generating ions of sample material in a mass spectrometer, wherein the method includes:

directing light on to the at least one surface of the ion source such that contaminant material is desorbed from the at least one surface such that there is substantially no heating of the at least one surface.

Here, "substantially no heating" may be taken to mean that the temperature at the at least one surface of the ion source remains less than 80 degrees Celsius, more preferably that the temperature at the at least one surface of the ion source remains less than 60 degrees Celsius. This is different from, for example, the method proposed in GB2457362 in which infrared laser radiation is used to deliberately heat the electrodes of MALDI ion sources to at least 80 degrees Celsius.

The light directed on to the at least one surface of the ion source may be UV light (as in the above described first aspect of the invention), but this need not be the case since other wavelengths of light may also be able to desorb contaminant material from the at least one surface.

The method may include any feature or method step described in connection with any other aspect of the invention, without the light directed on to the at least one surface of the ion source necessarily being UV light.

A tenth aspect of the invention relates to an apparatus for carrying out a method according to the ninth aspect of the invention.

Accordingly, a tenth aspect of the invention may provide an ion source for generating ions in a mass spectrometer, the ion source having:

means for directing light on to the at least one surface of the ion source such that contaminant material is desorbed from the at least one surface such that there is substantially no heating of the at least one surface.

The light directed on to the at least one surface of the ion source may be UV light (as in the above described first aspect of the invention), but this need not be the case since other wavelengths of light may also be able to desorb contaminant material from the at least one surface.

The ion source may have any feature described in connection with any above aspect of the invention and/or may be configured to, or have means for, implementing any method step described in connection with any above aspect of the invention, without the light directed on to the at least one electrode necessarily being UV light.

An eleventh aspect of the invention may provide a method of cleaning at least one surface of an ion source for generating ions of sample material in a mass spectrometer, wherein the method includes:

directing light on to the at least one surface of the ion source such that contaminant material is desorbed from the at least one surface, wherein the light directed on to the at least one surface of the ion source has a wavelength at which the contaminant material is absorbent.

By using light having a wavelength at which the contaminant material is absorbent, the light is able to couple energy directly into contaminant material on the at least one surface so as to cause the contaminant material to desorb from the at least one surface without having to significantly heat the at least one surface. This mechanism is different from, for example, the method proposed in GB2457362 in which infrared laser radiation (which is less energetic than UV light) is used to clean electrodes by deliberately heating the electrodes of MALDI ion sources up to a high temperature.

Preferably, "a wavelength at which the contaminant material is absorbent" is defined as a wavelength of light at which the percentage transmission of the contaminant material is 75% or less, more preferably 50% or less more preferably 25% or less.

The contaminant material may, for example, include or be non-ionised sample material and/or light absorbing matrix such as DCTB, DHB, SA, DTL or CHCA.

Preferably, the light has a wavelength of 450 nm or less, more preferably less than 400 nm or less, more preferably 390 nm or less. Preferably, the light has a wavelength of 10 nm or more, 100 nm or more, 200 nm or more or 300 nm or more. Accordingly, the UV light may have a wavelength in the range 10 nm to 390 nm, 400 nm or 450 nm; 100 nm to 390 nm, 400 nm or 450 nm; 200 nm to 390 nm, 400 nm or 450 nm; or 300 nm to 390 nm, 400 nm or 450 nm. Contaminant material, which may include light absorbing matrices such as DCTB, DHB, SA, DTL or CHCA, has been found to be particularly absorbent to light having a wavelength in these ranges, thereby allowing the light to couple energy directly into contaminant material on the at least one surface of the ion source so as to cause the contaminant material to desorb from the at least one surface without having to significantly heat the at least one surface. However, contaminant material may also be absorbent to wavelengths outside these ranges.

The light directed on to the at least one surface of the ion source may be UV light (as in the above described first aspect of the invention), but this need not be the case since other wavelengths of light may also be able to desorb contaminant material from the at least one surface.

The method may include any feature or method step described in connection with any other aspect of the invention, without the light directed on to the at least one surface of the ion source necessarily being UV light.

A twelfth aspect of the invention relates to an apparatus for carrying out a method according to the eleventh aspect of the invention.

Accordingly, a twelfth aspect of the invention may provide an ion source for generating ions in a mass spectrometer, the ion source having:

means for directing light on to the at least one surface of the ion source such that contaminant material is desorbed from the at least one surface, wherein the light directed on to the at least one surface of the ion source has a wavelength at which the contaminant material is absorbent.

The light directed on to the at least one surface of the ion source may be UV light (as in the above described first aspect of the invention), but this need not be the case since other wavelengths of light may also be able to desorb contaminant material from the at least one surface.

The ion source may have any feature described in connection with any above aspect of the invention and/or may be configured to, or have means for, implementing any method step described in connection with any above aspect of the invention, without the light directed on to the at least one electrode necessarily being UV light.

In any above aspect, the ion source may be a MALDI ion source. For a MALDI ion source, the sample material may include biomolecules (e.g. proteins), organic molecules and/or polymers. The sample material may be included in a (preferably crystallised) mixture of sample material and light absorbing matrix. Cleaning electrodes has been found to be a particular concern for MALDI ion sources. However, the electrodes of other types of ion source may also need cleaning.

In any above aspect, the at least one surface of the ion source preferably comprises a surface of an electrode of the ion source. The electrode may be a first electrode of the ion source, where "first electrode" is taken to mean an electrode closest to a sample spot (or a sample holding means) of the ion source. The electrode may be an acceleration electrode for producing an electric field to accelerate ions generated by the ion source to a predetermined kinetic energy, e.g. to provide a pulse of ions. The electrode may additionally, or alternatively, be for guiding the ions. Cleaning acceleration electrodes has been found to be a particular concern in ion sources for mass spectrometers, particularly MALDI ion sources. However, other types of electrode and other types of surface may also need cleaning.

In any above aspect, the ion source may include a sample holding means for holding sample material to be ionised by the ion source. The sample holding means may include a sample plate for holding sample material in one or more "sample spots". The sample holding means may include a sample plate carrier for carrying a sample plate. The sample plate is preferably configured to be removed from the ion source whereas the sample plate carrier may be non-removably mounted within the ion source.

In any above aspect, the ion source preferably includes a housing for containing the at least one electrode and/or a sample holding means. The housing is preferably configured to be evacuated, i.e. configured to contain a vacuum. Preferably, in an above described method, light (preferably UV light) is directed on to the at least one electrode of the ion source such that contaminant material is desorbed from the at least one electrode whilst the housing is evacuated. In other words, the housing is preferably not vented for the cleaning of the at least one electrode.

In any above aspect, the ion source may be included in a mass spectrometer, preferably a TOF mass spectrometer, more preferably a MALDI TOF mass spectrometer. The mass spectrometer may include an ion detector for detecting ions, e.g. a pulse of ions, generated by the ion source.

The invention also includes any combination of the aspects and preferred features described except where such a combination is clearly impermissible or expressly avoided.

BRIEF DESCRIPTION OF THE DRAWINGS

Embodiments of these proposals are discussed below, with reference to the accompanying drawings in which.

DESCRIPTION OF EMBODIMENTS AND EXPERIMENTS

Figure 1:
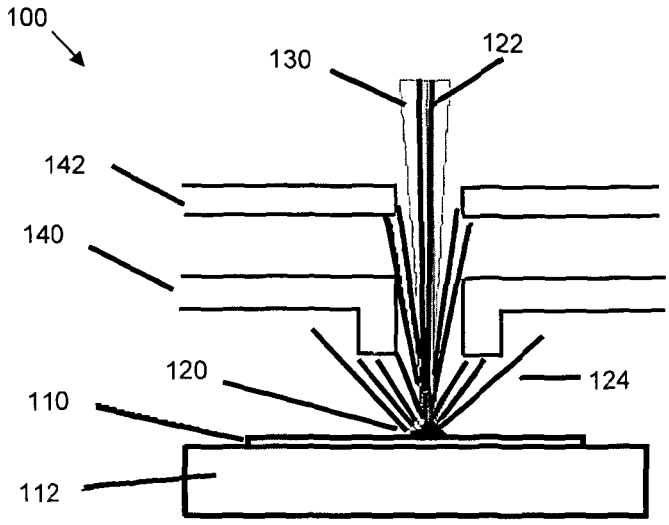
FIG. 1 shows a MALDI ion source configuration used by the present inventors before the development of the present invention.

FIG. 1 shows a MALDI ion source configuration, including a MALDI ion source 100, used by the present inventors before the development of the present invention.

The MALDI ion source 100 shown in FIG. 1 has a sample plate holding means for holding sample material to be ionised by the MALDI ion source 100. The sample holding means includes a sample plate 110, which is removable from the MALDI ion source 100, for holding a crystallised mixture of sample material and light absorbing matrix in a sample spot 120, and a sample plate carrier 112, which is not removable from the MALDI ion source 100, for carrying the sample plate 110.

The MALDI ion source 100 also has a laser (not shown) for ionising sample material by firing pulses of light, in this embodiment pulses of UV light, in the form of a pulsed laser beam 130, at the sample material. As shown in FIG. 1, the UV light produced by the laser is focused to converge at a focal point whose position coincides with the sample spot 120.

The MALDI ion source 100 also has a first electrode 140 and a second electrode 142 for producing an electric field to accelerate ions generated by the laser to a predetermined kinetic energy, e.g. 20 keV. The first and second electrodes 140, 142 are each shaped to define an aperture through which ions generated by the laser can pass through as they are accelerated by the first and second electrodes 140, 142.

The MALDI ion source 100 also includes a housing (not shown) for containing the electrodes 140, 142 and the sample holding means. The housing is preferably evacuated prior to the MALDI ion source 100 being used.

In use, the laser fires a pulse of light at the mixture of sample material and light absorbing matrix contained in the sample spot 120 so as to eject a plume of ionised and non-ionised (i.e. neutral) sample material ("analyte") and light absorbing matrix. The ionised material 122 contained in this plume (mostly ions of sample material and some ions of light absorbing matrix) will generally be accelerated away by an electric field produced by the first and second electrodes 140, 142 so as to pass through the apertures in the first and second electrodes 140, 142, e.g. for subsequent detection by an ion detector. However, the non-ionised material 124 contained in this plume (mostly non-ionised light absorbing matrix and some non-ionised sample material) will generally continue to expand from the sample spot 120 until it is deposited on surfaces in the vicinity of the sample spot, e.g. surfaces of the first and second electrodes 140, 142. In general, much of the non-ionised material 124 will be deposited on a surface of the first electrode 140, but some non-ionised material 124 may also pass through the aperture in the first electrode 140 to be deposited on a surface of second electrode 142.

Over time, the non-ionised material builds up on the surfaces in the vicinity of the sample spot, particularly on the surfaces of the first and second electrodes 140, 142, to form an insulating layer of contaminant material that may charge up over time and adversely affect the operation of the MALDI ion source 100. In particular, the insulating layer of contaminant material on the first and second electrodes 140, 142 can distort the electric field produced by the first and second electrodes 140, 142 such that the sensitivity or resolution of a mass spectrometer using the MALDI ion source 100 is degraded. At this point the first and second electrodes 140, 142 of the MALDI ion source will generally require cleaning.

Figure 2:
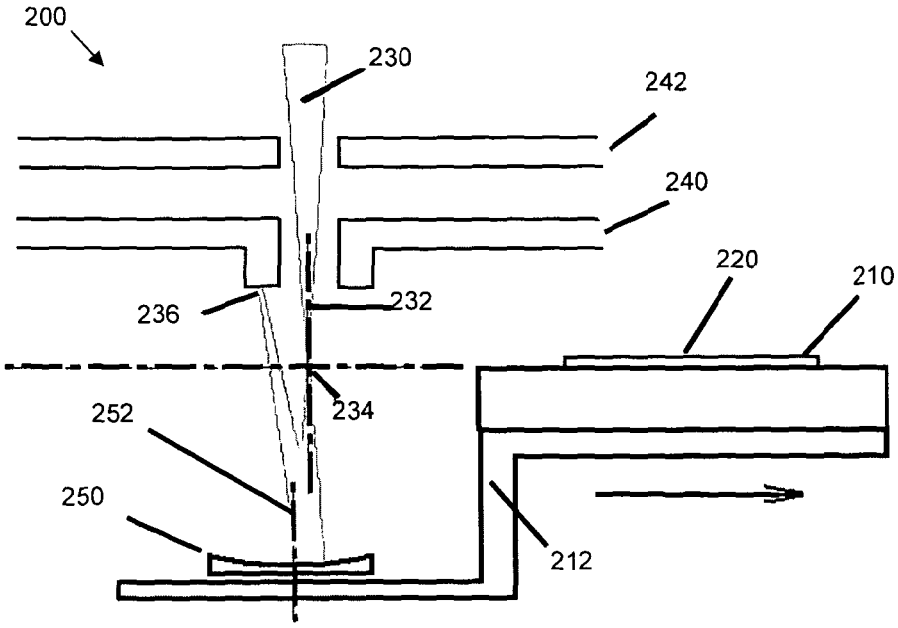
FIG. 2 shows a MALDI ion source configuration used by the present inventors after the development of the present invention.

FIG. 2 shows a MALDI ion source configuration, including a MALDI ion source 200, used by the present inventors after the development of the present invention.

Many features of the MALDI ion source 200 shown in FIG. 2 are the same as those of the MALDI ion source 100 shown in FIG. 1. These features have been given corresponding reference numerals and need not be discussed in further detail.

As can be seen from FIG. 2, the sample holding means includes a differently shaped sample plate carrier 212, having both a first level on which the sample plate 210 is mounted and a second level on which a UV mirror 250 concave reflecting surface provided by a UV mirror 250. Thus, the mirror is mounted on the sample plate carrier 212 such that the reflecting surface is at a different distance from the laser for ionising sample material. In this example, the concave reflecting surface of the mirror 250 has a generally spherical curvature and a central axis 252.

The sample plate carrier is configured to be moved in a plane substantially perpendicular to a beam axis 232 of the laser for ionising sample material so as to allow both the sample plate 210, and the mirror 250, to be moved into and out of the beam axis 232.

In use to generate ions, a sample spot 220 on the sample plate 210 is moved into the beam axis 232 of the laser such that UV light from the laser is focussed to converge at a first focal point 234 whose position coincides with the sample spot 220.

In use to clean one of the electrodes 240, 242, the mirror 250 is moved into the beam axis 232 of the laser such that UV light from the laser is directed on to a surface of one of the electrodes 240, 242 via the mirror 250 which reflects the UV light from the laser. Advantageously, the UV light is able to couple energy directly into contaminant material on the surface of the electrode so as to cause the contaminant material to desorb from the surface of the electrode without having to significantly heat the electrode, and without having to vent the evacuated housing of the MALDI ion source 200.

Once located in the beam axis 232 of the laser, the mirror 250 is preferably translated, e.g. continuously, in a plane substantially perpendicular to the beam axis 232 of the laser, such that the UV light from the laser is scanned across a surface of either or both of the electrodes 240, 242, preferably in two dimensions.

As shown in FIG. 2, the UV light from the laser is firstly focussed by one or more lenses associated with the laser (not shown) to converge at a first focal point 234 and is subsequently refocused by the mirror 250 to converge at a second focal point 236. As shown in FIG. 2, the position of the second focal point 236 is at a surface of the first electrode 240. However, in other preferred embodiments, the position of the second focal point 236 can be other than at a surface of an electrode, e.g. to achieve a predetermined energy density at a surface of the electrode.

Figure 3:
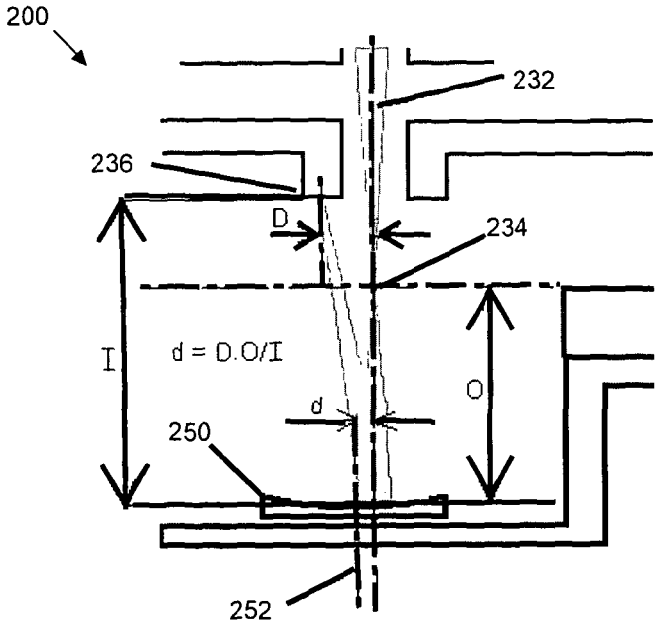
FIG. 3 illustrates the geometry of the MALDI ion source configuration shown in FIG. 2.

FIG. 3 illustrates the geometry of the MALDI ion source configuration shown in FIG. 2.

Because, in this example, the concave reflecting surface of the mirror 250 has a generally spherical curvature, there will be a generally linear relationship between the lateral translation of the mirror 250 (which is determined by the lateral translation of the sample plate carrier 212) and the movement of the second focal point 236 of the UV light from the laser across a surface of the electrodes 240, 242.

In more detail, as can be seen from FIG. 3, the second focal point 236 of the UV light from the laser will generally be displaced laterally from the beam axis 232 of the laser by a distance given by $D=dM_T$, where d is the lateral displacement of the central axis 252 of the mirror 250 from the beam axis 232 of the laser and $M_T$ is the transverse magnification of the mirror 250. The transverse magnification $M_T$ of the mirror 250 may be given by $M_T=I/O$, where O is an object distance for the mirror 250 (which in FIG. 3 is the distance along the beam axis 232 of the laser between the mirror 250 and the first focal point 234) and I is the image distance for the mirror 250 (which in FIG. 3 is the distance along the beam axis 232 of the laser between the mirror 250 and the second focal point 236). A value for the focal length f of the mirror 250 may be calculated for given values of I and O using the thin lens equation $f=O\cdot I/(O+I)$ and the radius of curvature R of the mirror 250 by the equation $R=2f$.

The UV light from the laser can either be focused by the mirror 250 to have a minimum spot size at a surface of an electrode to maximise the energy density per pulse (as shown in FIG. 3, where the second focal point 236 is at a surface of the first electrode 240) or can be only partially focused to allow a larger area to be irradiated per pulse. In practice, it has been found that the most effective desorption of contaminant material can be achieved by having an energy density that is somewhere between these extremes. In particular, it has been found that, for a laser producing pulses of UV light each having an energy of 40 μJ per pulse, efficient cleaning can be achieved by focussing the UV light at a surface of an electrode to have a $1/e^2$ diameter of 0.3 mm, so as to clean a circle of diameter 0.25 mm per pulse. This corresponds to an energy density of $40\ \mu J/\pi(0.3/2)^2$-600 $\mu J/mm^2$ per pulse.

By cleaning a circle of diameter of 0.25 mm per pulse, an area of 1 $cm^2$ (=100 $mm^2$) can be cleaned with approximately 2500 pulses ($100/\pi(0.25/2)^2$). Hence, for a sample plate carrier moving at 5 mm/s and laser repetition rate of 30 pulses/s, an area of 1 $cm^2$ can be cleaned very rapidly, at approximately 80 $s/cm^2$. The area of contaminated electrode that typically needs cleaning is of the order of 10 $cm^2$ and thus a total cleaning time for a contaminated electrode may typically be between 15 and 30 minutes.

Figure 4:
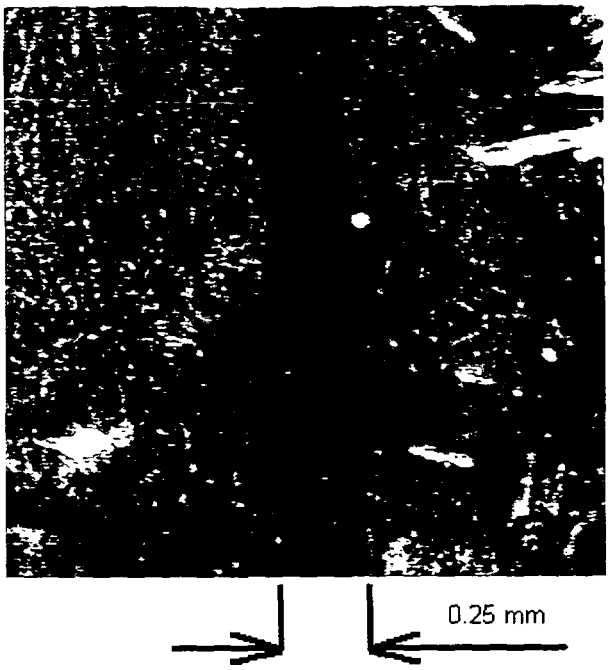
FIG. 4 shows a stainless steel electrode of which a 0.25 mm strip has been cleaned of DHB light absorbing matrix.
Figure 5:
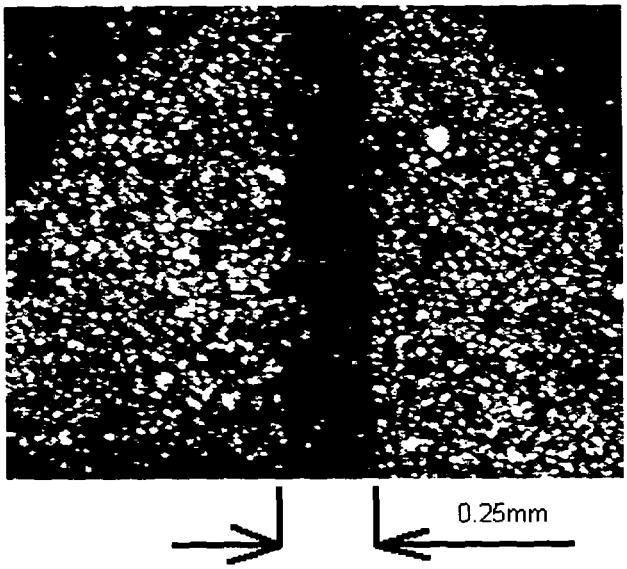
FIG. 5 shows a stainless steel electrode of which a 0.25 mm strip has been cleaned of CHCA light absorbing matrix.

FIGS. 4 and 5 each show a stainless steel electrode of which a 0.25 mm strip has been cleaned of DHB and CHCA light absorbing matrix respectively. For the examples shown in FIGS. 4 and 5, a UV spherical mirror of 25 mm focal length was positioned 44 mm below the plane of the sample plate such that the beam would have been focused to at a second focal point positioned at a distance of 58 mm from the mirror, had it not been intercepted by a first electrode located 52 mm above the mirror. Thus the pulses of UV light from a laser irradiated the first electrode 6 mm away from the second focal point, which allowed the 0.25 mm wide strip to be cleared in a single pass of the laser.

The majority of the contaminant material in the MALDI ion source 200 shown in FIG. 2 will be deposited towards the centre of the first electrode 240, but some will be deposited further out on the first electrode 240 and some will pass through the aperture in the first electrode 240 and be deposited on the second electrode 242. These further surfaces are at different distances from the mirror 250 and an adjustment of the focus of the UV light is required to focus the UV light such that substantially the same predetermined energy density is obtained at these surfaces. The predetermined energy density may be around 600 $\mu J/mm^2$ per pulse, for example.

This adjustment of focus can readily be achieved using various different methodologies, which may be combined.

Figure 6:
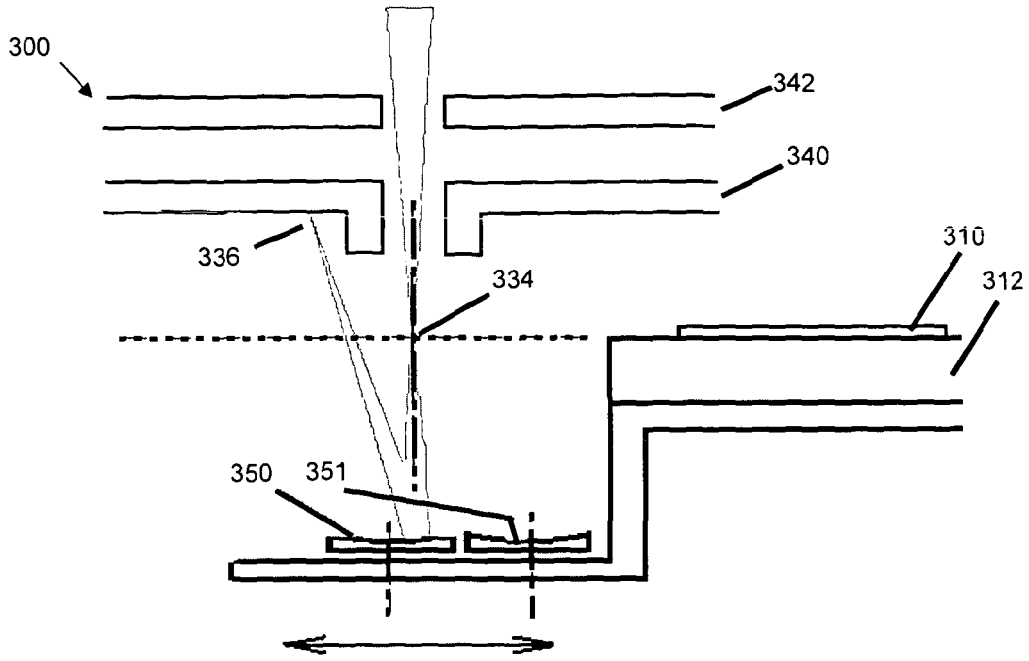
FIG. 6 shows a MALDI ion source configuration which implements a first possible methodology for adjusting the focus of UV light.

FIG. 6 shows a MALDI ion source configuration, including a MALDI ion source 300, which implements a first possible methodology for adjusting the focus of UV light.

Many features of the MALDI ion source 300 shown in FIG. 6 are the same as those of the MALDI ion source 200 shown in FIG. 2. These features have been given corresponding reference numerals and need not be discussed in further detail.

The MALDI ion source 300 shown in FIG. 6 uses two (or more) mirrors 350, 351 each having a respective concave surface with a different curvature to the other. In this example, the concave surfaces of the two mirrors 350, 351 both have a spherical curvature, with different focal lengths. The concave surface of the first mirror 350 focuses UV light from the laser to have a first focus such that the UV light has a predetermined energy density at a surface of the first electrode 340, whereas the concave surface of the second mirror 351 focuses UV light from the laser to have a second focus such that the UV light has the same predetermined energy density at a surface of the second electrode 342.

Figure 7:
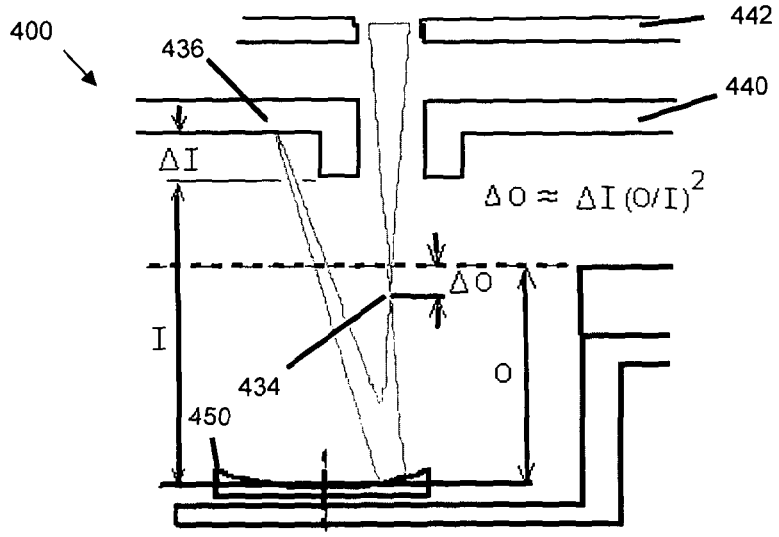
FIG. 7 shows a MALDI ion source configuration which implements a second possible methodology for adjusting the focus of UV light.

FIG. 7 shows a MALDI ion source configuration, including a MALDI ion source 400, which implements a second possible methodology for adjusting the focus of UV light.

Many features of the MALDI ion source 400 shown in FIG. 7 are the same as those of the MALDI ion source 200 shown in FIG. 2. These features have been given corresponding reference numerals and need not be discussed in further detail.

The MALDI ion source 400 shown in FIG. 7 adjusts the focus of the UV light by adjusting the position of a lens in the path of the UV light. In this example, the lens is associated with the laser, wherein adjustment of the position of this lens causes a shift the position of the first focal point 434. The relationship between the shift in position of the second focal point 436 ($\Delta I$) and the shift in position of the first focal point 434 ($\Delta O$) is generally determined by the longitudinal magnification ($M_L$), and can be approximated using the relation $\Delta I - \Delta I(O/I)^2$. This relation may be used to calculate a change in position of the first focal point 434 ($\Delta O$) needed to give the required shift in the second focal point 436 ($\Delta I$), to allow focused beam to be switched between different surfaces of the first and second electrodes 440, 442.

The methods described herein may be automated and can provide rapid and very efficient cleaning of the electrodes of an ion source to be carried out, without the need for removing the ion source, venting a housing of the ion source, or even removing a sample plate from the ion source.

A further advantage of the methods described herein is that a mirror used to reflect UV light from the laser can also be used to relay an image of at least one electrode into the object plane of a sample plate imaging system to enable the amount (or degree) of contaminant material present on the at least one electrode to be visually assessed using the sample plate imaging system.

The methods described herein have been found to be effective in cleaning all common light absorbing matrixes from electrodes even when an appreciable layer of contaminant material has been allowed to build up.

Although certain parameters (e.g. distances, energy densities etc) have been provided in connection with the methods described herein, it is to be appreciated that the parameters used to obtain the most efficient cleaning will, in general, depend on the ion source to be cleaned.

When used in this specification and claims, the terms "comprises" and "comprising" and variations thereof mean that the specified features, steps or integers are included. The terms are not to be interpreted to exclude the presence of other features, steps or integers.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilised for realising the invention in diverse forms thereof.

While the invention has been described in conjunction with the exemplary embodiments described above, many equivalent modifications and variations will be apparent to those skilled in the art when given this disclosure, without departing from the broad concepts disclosed. It is therefore intended that the scope of the patent granted hereon be limited only by the appended claims, as interpreted with reference to the description and drawings, and not by limitation of the embodiments described herein.

For example, whilst the present invention has been explained in connection with cleaning the surfaces of electrodes of MALDI ion sources, it is thought the same principles would apply to cleaning other types of surfaces and other types of ion source.

Also, although in the above described examples, the light directed on to at least one electrode of an ion source is produced by a laser for ionising sample material, in other examples, the light directed on to may be produced by a separate (e.g. external) light source. Similarly, in some embodiments, light which is not UV light may be used.

The invention claimed is:

1. A method of cleaning at least one surface of an ion source for generating ions of sample material in a mass spectrometer, wherein the at least one surface of the ion source comprises a surface of an electrode of the ion source, wherein the ion source includes a laser for ionising sample material by firing UV light at the sample material, wherein the method of cleaning includes:

directing UV light on to the at least one surface of the ion source such that contaminant material is desorbed from the at least one surface;

wherein the UV light directed on to the at least one surface of the ion source is produced by the laser for ionising sample material.

2. A method according to claim 1, wherein directing UV light on to the at least one surface of the ion source includes reflecting the UV light produced by the laser for ionising sample material onto the at least one surface of the ion source via a reflecting surface.

3. A method according to claim 2, wherein the directing UV light on to the at least one surface of the ion source includes moving the reflecting surface into a path of the UV light produced by the laser so that the reflecting surface reflects the UV light.

4. A method according to claim 2, wherein the reflecting surface is a concave reflecting surface.

5. A method according to claim 2, wherein the method includes moving the reflecting surface to scan UV light produced by the laser for ionising sample material across the at least one surface of the ion source.

6. A method according to claim 2, wherein the reflecting surface is mounted on a sample holding means for holding sample material to be ionised by the ion source.

7. A method according to claim 2, wherein the method includes using the reflecting surface to visually assess the amount of contaminant material present on the at least one surface of the ion source.

8. A method according to claim 1, wherein the method includes focusing the UV light such that the UV light has a predetermined energy density at the at least one surface of the ion source.

9. A method according to claim 1, wherein the method includes:

directing pulses of UV light on to the at least one surface of the ion source; and focusing the pulses of UV light such that each pulse of UV light has an energy density at the at least one surface of the electrode of the ion source that is from 400 $\mu J/mm^2$ to 1000 $\mu J/mm^2$.

10. A method according to claim 1, wherein the method includes:

adjusting the focus of the UV light between a first focus and a second focus; and directing UV light having the first focus onto a first surface of the ion source and directing UV light having the second focus onto the second surface of the ion source.

11. A method according to claim 10, wherein the focus of the UV light is adjusted by directing UV light on to the at least one surface of the ion source using at least two concave reflecting surfaces, each concave reflecting surface having a different curvature.

12. A method according to claim 10, wherein the focus of the UV light is adjusted by adjusting a position of a lens in a path of the UV light.

13. A method according to claim 1, wherein the method includes at least one of:

(a) directing UV light on to the at least one surface of the ion source such that the UV light couples energy directly into contaminant material on the at least one surface of the ion source such that contaminant material is desorbed from the surface;

(b) directing UV light on to the at least one surface of the ion source such that contaminant material is desorbed from the at least one surface such that there is substantially no heating of the at least one surface;

(c) directing UV light on to the at least one surface of the ion source such that contaminant material is desorbed from the at least one surface, wherein the light directed on to the at least one surface of the ion source has a wavelength at which the contaminant material is absorbent.

14. A method according to claim 1, wherein the ion source is a MALDI ion source.

15. A method according to claim 1, wherein the ion source includes a first electrode that is an acceleration electrode for producing an electric field to accelerate ions generated by the ion source to a predetermined kinetic energy, wherein the at least one surface of the ion source includes a surface of the first electrode of the ion source.

16. A method according to claim 1, wherein the ion source is included in a TOF mass spectrometer.

* * * * *